US011421518B2

(12) United States Patent
Fielder et al.

(10) Patent No.: US 11,421,518 B2
(45) Date of Patent: Aug. 23, 2022

(54) APPARATUSES AND SYSTEMS FOR REGULATING FLOW FROM A GEOLOGICAL FORMATION, AND RELATED METHODS

(71) Applicant: FORUM US, INC., Houston, TX (US)

(72) Inventors: Lance Fielder, Sugar Land, TX (US); Kyle Robert Meier, Sugar Land, TX (US); Avinash Gopal Dharne, Houston, TX (US); Robert P. Fielder, III, Houston, TX (US)

(73) Assignee: FORUM US, INC., Houston, TX (US)

( * ) Notice: Subject to any disclaimer, the term of this patent is extended or adjusted under 35 U.S.C. 154(b) by 165 days.

(21) Appl. No.: 16/041,340

(22) Filed: Jul. 20, 2018

(65) Prior Publication Data

US 2019/0024491 A1 Jan. 24, 2019

Related U.S. Application Data

(60) Provisional application No. 62/535,530, filed on Jul. 21, 2017.

(51) Int. Cl.

| | |
|---|---|
| ***E21B 43/38*** | (2006.01) |
| ***F04D 9/00*** | (2006.01) |
| ***E21B 43/12*** | (2006.01) |

(52) U.S. Cl.

CPC ..... *E21B 43/38* (2013.01); *E21B 43/121* (2013.01); *F04D 9/001* (2013.01); *F04D 9/007* (2013.01)

(58) Field of Classification Search

CPC ..... E21B 43/38; E21B 43/121

See application file for complete search history.

(56) References Cited

U.S. PATENT DOCUMENTS

| | | | | |
|---|---|---|---|---|
| 2,651,259 A | | 9/1953 | Brush | |
| 4,135,861 A | * | 1/1979 | Brown | F04F 5/24 417/183 |
| 4,381,175 A | | 4/1983 | Erickson | |

(Continued)

FOREIGN PATENT DOCUMENTS

| | | |
|---|---|---|
| EP | 0034079 A1 | 8/1981 |
| WO | 2005045189 A1 | 5/2005 |

OTHER PUBLICATIONS

International Search Report and Written Opinion dated Nov. 7, 2018, corresponding to Application No. PCT/US2018/043115.

(Continued)

*Primary Examiner* — Blake Michener
*Assistant Examiner* — Neel Girish Patel
(74) *Attorney, Agent, or Firm* — Patterson & Sheridan, L.L.P.

(57) ABSTRACT

Systems and apparatuses for regulating a multi-phase fluid stream flowing from a subterranean geological formation, and related methods are described herein. The system and apparatus generally include a conduit defining a flow path for the fluid stream, the conduit further defining a first restriction having a throat portion, and the conduit further defining a first return path including an inlet positioned downstream of the first restriction and an outlet positioned upstream of the inlet of the first return path. Related methods include placing the apparatus or system within a wellbore conduit defined by a wellbore.

17 Claims, 6 Drawing Sheets

(56) References Cited

U.S. PATENT DOCUMENTS 4,605,069 A * 8/1986 McClaflin ..... E21B 37/06 166/310
4,664,603 A * 5/1987 Priestly ..... F04F 5/464 417/172
4,744,730 A * 5/1988 Roeder ..... E21B 43/124 417/172
5,154,588 A 10/1992 Freet et al.
5,472,054 A * 12/1995 Hinds ..... E21B 34/10 166/106
5,628,616 A 5/1997 Lee
5,806,599 A 9/1998 Hisaw et al.
5,934,372 A * 8/1999 Muth ..... F04B 53/122 166/72
6,007,306 A 12/1999 Vilagines
6,041,803 A 3/2000 De Almeida et al.
6,053,261 A * 4/2000 Walter ..... E21B 4/14 175/234
6,059,040 A 5/2000 Levitan et al.
6,330,915 B1 12/2001 Moya
6,357,530 B1 3/2002 Kennedy et al.
6,390,114 B1 5/2002 Haandrikman et al.
6,394,183 B1 * 5/2002 Schrenkel ..... E21B 43/38 166/265
6,698,521 B2 3/2004 Schrenkel et al.
6,875,247 B2 4/2005 TeGrotenhuis et al.
7,287,597 B2 10/2007 Shaposhnikov et al.
7,555,964 B2 7/2009 Mayeaux
7,882,896 B2 2/2011 Wilson et al.
7,997,335 B2 8/2011 Brown et al.
8,215,407 B2 7/2012 Dinkins
8,327,941 B2 12/2012 Hackworth et al.
9,297,239 B2 * 3/2016 Lopez Robayo ..... E21B 43/124
9,366,127 B1 6/2016 McCoy
9,835,019 B2 12/2017 Saponja et al.
9,909,405 B2 3/2018 Hemstock
9,915,134 B2 3/2018 Xiao et al.
10,113,393 B2 10/2018 Saponja et al.
10,253,611 B2 4/2019 Saponja et al.
10,280,727 B2 5/2019 Saponja et al.
10,378,328 B2 8/2019 Saponja et al.
2003/0196952 A1 10/2003 Kampfen
2004/0104023 A1 6/2004 Stark et al.
2005/0002812 A1 1/2005 Dass
2005/0045337 A1 * 3/2005 Bansal ..... E21B 36/006 166/369
2005/0051340 A1 * 3/2005 Williams ..... E21B 43/006 166/370
2006/0213652 A1 * 9/2006 Shaposhnikov .... E21B 41/0078 166/68
2009/0035067 A1 2/2009 Wilson et al.
2009/0120638 A1 5/2009 Shaw
2010/0096141 A1 * 4/2010 Brown ..... E21B 43/36 166/369
2010/0101798 A1 * 4/2010 Simpson ..... E21B 43/121 166/313
2012/0073820 A1 * 3/2012 Rankin ..... E21B 43/121 166/309
2012/0132289 A1 * 5/2012 Kolle ..... E21B 43/003 137/14
2012/0175127 A1 * 7/2012 Yale ..... E21B 43/124 166/372
2012/0273221 A1 * 11/2012 Robayo ..... E21B 43/124 166/372
2012/0292047 A1 * 11/2012 Knobloch, Jr. ..... E21B 37/00 166/378
2013/0306319 A1 * 11/2013 Kolle ..... E21B 47/22 166/305.1
2015/0053410 A1 * 2/2015 Arellano ..... E21B 43/38 166/309
2015/0075772 A1 * 3/2015 Saponja ..... E21B 43/121 166/115
2015/0226046 A1 * 8/2015 Wolf ..... F04C 13/008 166/372
2016/0138595 A1 5/2016 Becquin et al.
2016/0222773 A1 8/2016 Sims et al.
2016/0258231 A1 * 9/2016 Naumann ..... E21B 17/206
2017/0247958 A1 * 8/2017 Alfonzo Nunez ..... E21B 21/08
2017/0268322 A1 * 9/2017 Culbertson ..... E21B 43/127
2018/0073327 A1 * 3/2018 Theimer ..... F16K 31/1223

OTHER PUBLICATIONS

Non-Final Office Action dated Oct. 5, 2020 for U.S. Appl. No. 16/678,925.
Australian Examination Report dated Oct. 22, 2020 for Application No. 2018304477.
Indian Office Action dated Dec. 11, 2020 for Application No. 202047006201.
Canadian Office Action dated Mar. 26, 2021 for Application No. 3,070,103.
Canadian Office Action dated Dec. 7, 2021, for Canadian Patent Application No. 3,070,103.
Colombia Office Action dated Nov. 26, 2021, for Colombian Patent Application No. NC2020/0001739.
Examination Report dated Apr. 28, 2022 for Application No. 2021203033.
Office Action dated Mar. 14, 2022 for Application No. 520411096.

* cited by examiner

APPARATUSES AND SYSTEMS FOR REGULATING FLOW FROM A GEOLOGICAL FORMATION, AND RELATED METHODS

CROSS-REFERENCE TO RELATED APPLICATIONS

This application claims benefit of U.S. Provisional Patent Application Ser. No. 62/535,530, filed on Jul. 21, 2017, which is expressly incorporated herein by reference in its entirety.

BACKGROUND

Field

The present disclosure relates to apparatuses, systems and methods for regulating the flow of fluid streams from geological formations. More specifically, the present disclosure relates to apparatuses and systems for regulating a multi-phase fluid stream flowing from a subterranean geological formation, and related methods.

DESCRIPTION OF THE RELATED ART

Multi-phase flow is the simultaneous flow of more than one fluid phase (i.e., liquid, gas, or solid). Certain drilling operations produce both oil and gas from a subterranean geological formation, and often produce water. Consequently, multi-phase fluid flowing from such formations is generally a liquid, comprising more than one phase, such as water- or oil-based liquids, solid material or gas.

The expansion of shale fracking completion processes has created certain situations which can cause slugging events during lift processes, due to the prevalence of gas migration in the well bore. For example, in wells with long laterals, a pump is normally placed in a vertical or inclined portion of the wellbore to increase the pressure of the fluid and encourage the flow of the fluid stream to the surface.

When producing from these wells, the long laterals can create slug flow in the well bore. Slug flow is a multi-phase fluid flow regime characterized by a series of liquid plugs separated by a relatively large gas pocket. For example, slug flow in the vertical or inclined portion of the wellbore is typically a gas pocket, in an axially symmetrical bullet shape, that can occupy almost the entire cross-sectional area of the conduit. In other words, the resulting flow alternates between high-liquid and high-gas composition.

Although some pumps have been designed to pump fluid streams having slug flow, such systems are limited in the volume that they can produce. If the volume of the gas pockets exceeds the volume the pump can accommodate, then the pump can gas lock. For example, some pumps used in connection with fluid streams having a high gas/liquid oil ratio (GOR) have attempted to address this problem by compressing the gas back into the liquid at the intake of the pump. However, these pumps have limited success because they are often limited by the gas volume fraction (GVF) (i.e., the ratio of the gas volumetric flow rate to the total volumetric flow rate of all fluids). For example, most systems can work with a GVF in a range up to about 60% or 70%, but often become gas locked when slugs travel to the pump intake and deliver fluid having a GVF higher than the above mentioned range.

Contained herein is a disclosure directed to resolving, or at least reducing, one or more of the problems mentioned above, or other problems that may exist in the art.

SUMMARY

The present disclosure relates to apparatuses and systems for regulating a multi-phase fluid stream flowing from a subterranean geological formation, and related methods. The apparatus in one aspect generally comprises a conduit defining a flow path for the fluid stream. The conduit further defines a first restriction having a throat portion, and also defines a first return path including an inlet positioned downstream of the first restriction and an outlet positioned upstream of the inlet of the first return path. The first return path is sized and configured to permit at least a portion of the fluid stream to flow from the inlet to the outlet when the fluid stream flows through the apparatus thereby reducing a gas volume fraction of the fluid stream flowing downstream of the apparatus as compared to a gas volume fraction of the fluid stream upstream of the first restriction.

One or more aspects of the invention include the apparatus of the preceding paragraph, wherein the gas volume fraction of the fluid stream flowing downstream of the apparatus is less than or equal to about 0.30.

One or more aspects of the invention include the apparatus of any preceding paragraph, wherein the outlet of the first return path is positioned at or near the throat portion of the first restriction so as to cause the portion of the fluid stream to flow from the inlet to the outlet of the first return path.

One or more aspects of the invention include the apparatus of any preceding paragraph, wherein the first restriction is a convergent-divergent nozzle.

Another aspect of the invention provides the apparatus of any preceding paragraph, wherein the conduit further defines at least a second restriction positioned downstream of the first restriction.

One or more aspects of the invention include the apparatus of the preceding paragraph, wherein the outlet of the first return path is positioned at or near, either the throat portion of the first restriction or a throat portion of the second restriction, so as to cause the portion of the fluid stream to flow from the inlet to the outlet of the first return path.

One or more aspects of the invention include the apparatus of the preceding paragraph, wherein the second restriction is a convergent-divergent nozzle.

One or more aspects of the invention include the apparatus of any preceding paragraph, wherein the conduit further defines at least a second return path including an inlet positioned downstream of the first restriction, and an outlet positioned upstream of the inlet of the second return path.

One or more aspects of the invention include the apparatus of any preceding paragraph, wherein the outlet of the second return path is positioned at or near, either the throat portion of the first restriction or the throat portion of the second restriction, so as to cause the portion of the fluid stream to flow from the inlet to the outlet of the second return path.

Another aspect of the invention provides a system including the apparatus of any preceding paragraph. In one or more aspects the system further comprises a pump positioned downstream of the apparatus.

One or more aspects of the invention include the system of the preceding paragraph further comprising a first phase separator positioned downstream of the first restriction and upstream of the pump, wherein the phase separator is sized and configured to separate at least a portion of a gas from the fluid stream.

One or more aspects of the invention include the system of the preceding paragraph wherein the first phase separator is a gravity type separating device. One or more aspects of the invention include the system of any preceding paragraph, further comprising a second phase separator positioned upstream of the first restriction, wherein the phase separator is sized and configured to separate at least a portion of solid materials from the fluid stream.

Another aspect of the invention provides a method comprising placing an apparatus or system of any preceding paragraph within a wellbore conduit defined by a wellbore so as to regulate a gas volume fraction of a multi-phase fluid stream flowing therethrough.

While multiple embodiments are disclosed, still other embodiments will become apparent to those skilled in the art from the following detailed description. As will be apparent, certain embodiments, as disclosed herein, are capable of modifications in various obvious aspects, all without departing from the spirit and scope of the claims as presented herein. Accordingly, the drawings and detailed description are to be regarded as illustrative in nature and not restrictive.

BRIEF DESCRIPTION OF THE DRAWINGS

The claimed subject matter may be understood by reference to the following description taken in conjunction with the accompanying figures, in which like reference numerals identify like elements, and in which:

The accompanying drawings illustrate specific embodiments. However, it is to be understood that these embodiments are not intended to be exhaustive, nor limiting of the disclosure. These specific embodiments are but examples of some of the forms in which the disclosure may be practiced. Like reference numbers or symbols employed across the several figures are employed to refer to like parts or components illustrated therein.

DETAILED DESCRIPTION

Figure 1:
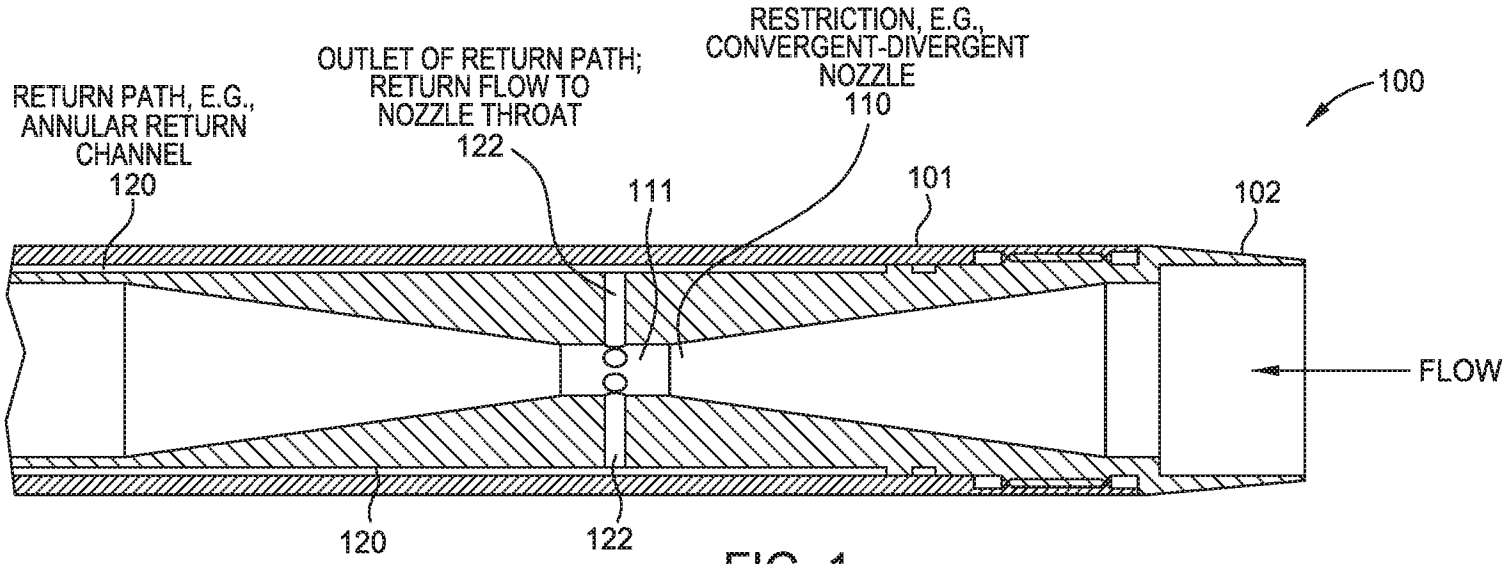
FIG. 1 illustrates a cross sectional view of an embodiment of an apparatus in accordance with this disclosure.
Figure 2:
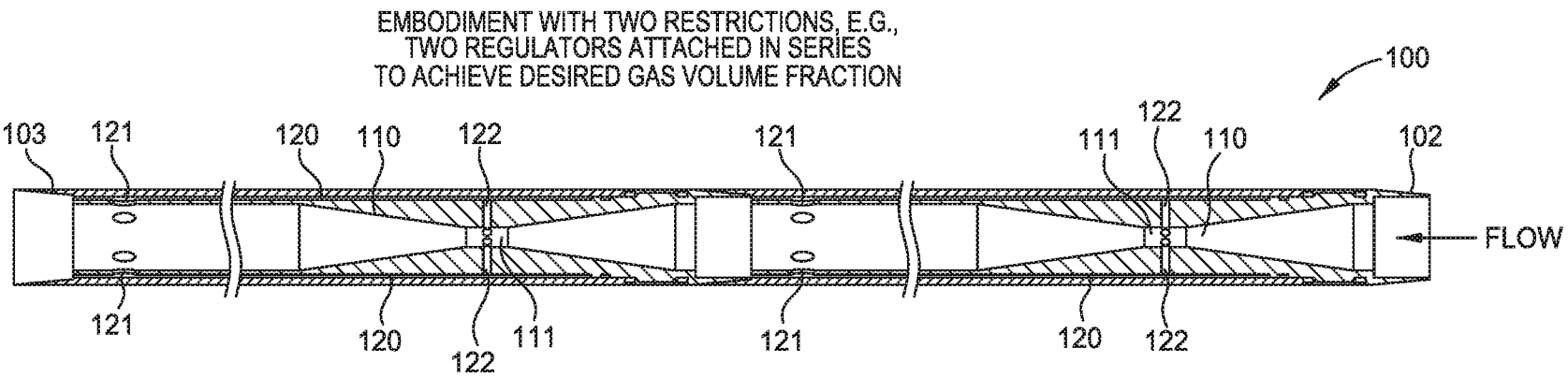
FIG. 2 illustrates a cross sectional view of an embodiment of an apparatus in accordance with this disclosure.
Figure 3A:
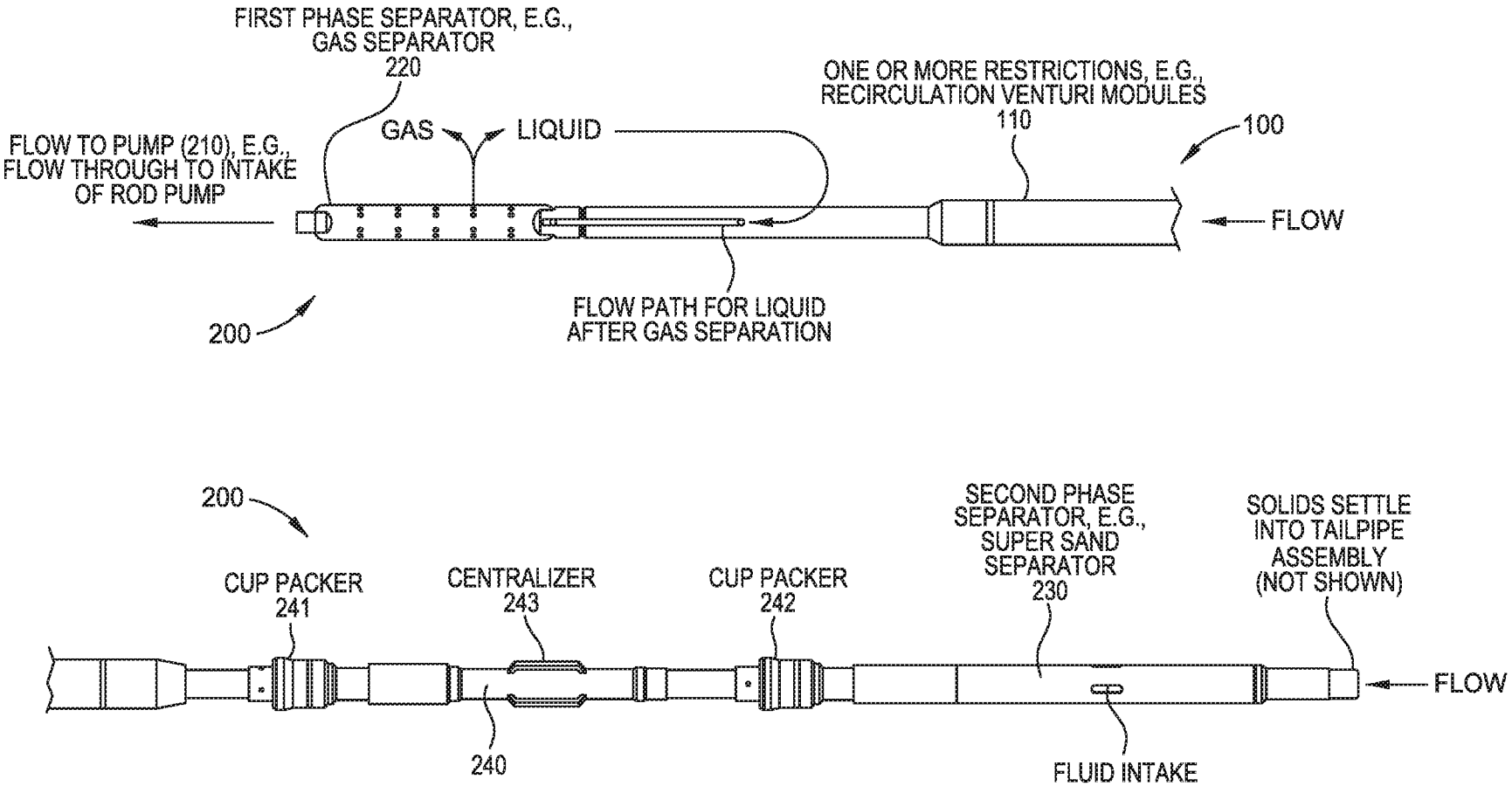
FIG. 3A illustrates an embodiment of a system having an apparatus in accordance with this disclosure.
Figure 3B:
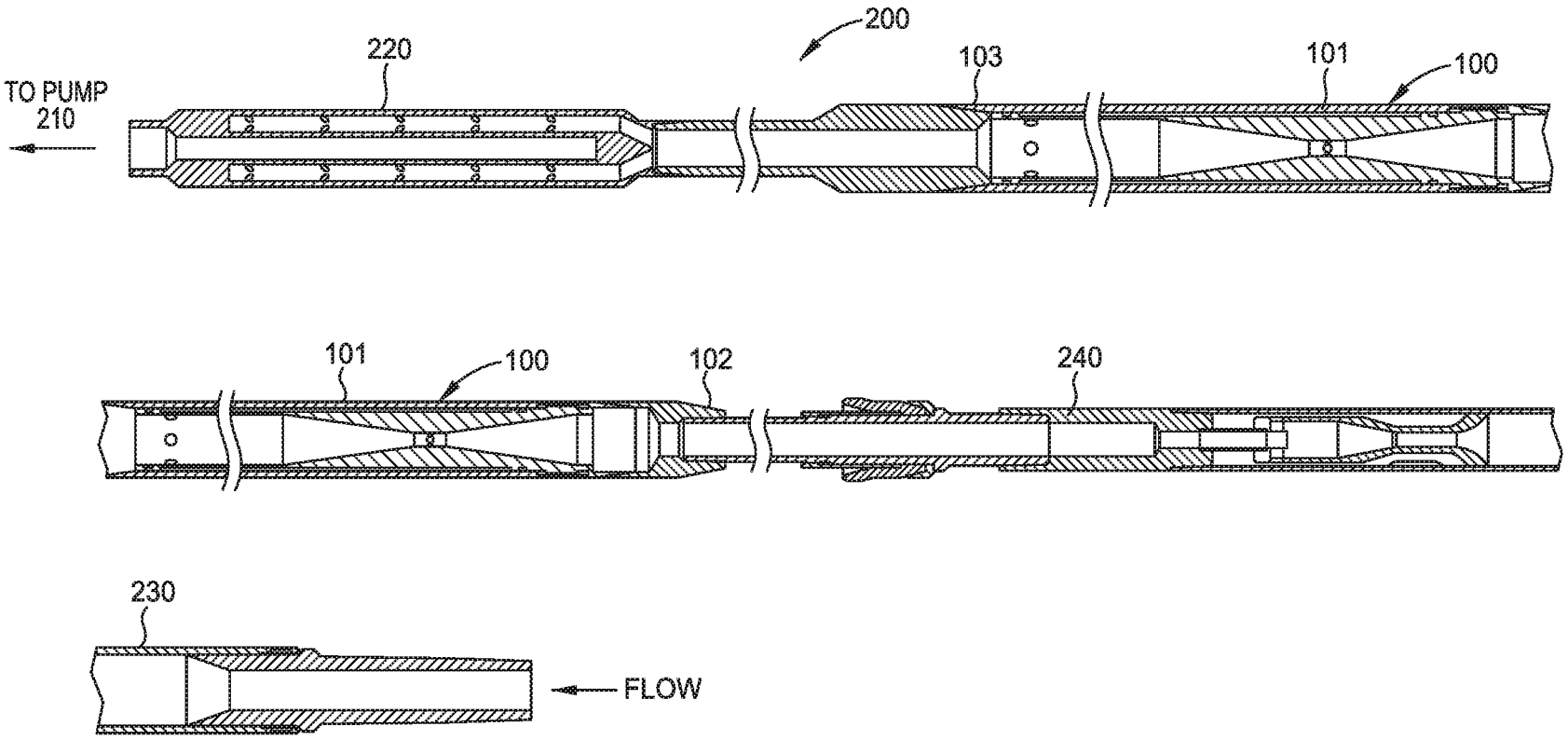
FIG. 3B illustrates a cross sectional view of the embodiment of the system illustrated in FIG. 3A.
Figure 4:
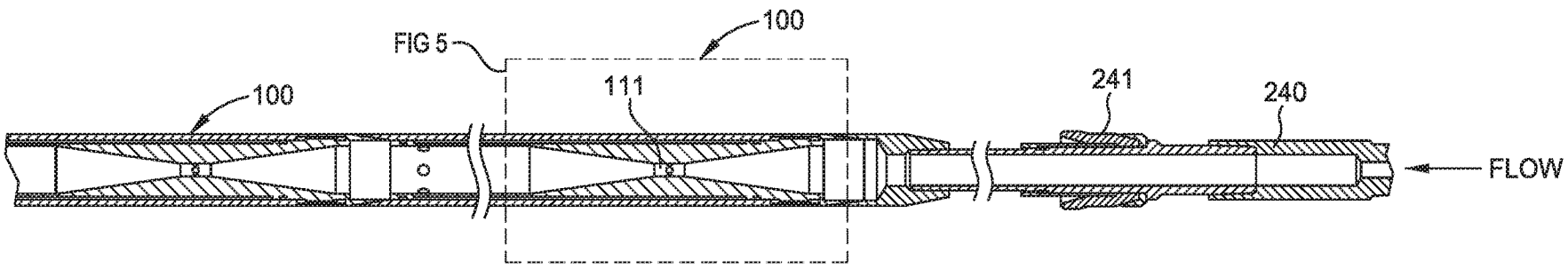
FIG. 4 illustrates a portion of the system illustrated in FIG. 3B.
Figure 5:
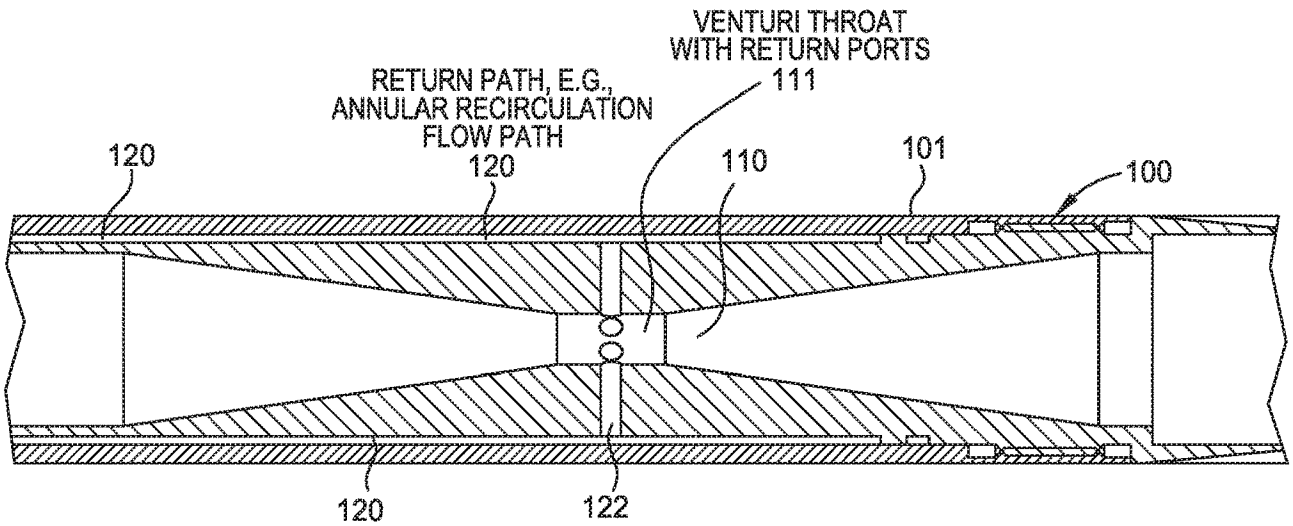
FIG. 5 illustrates a magnified view of a portion of the system illustrated in FIG. 4.

Disclosed herein are systems and apparatuses for regulating a multi-phase fluid stream flowing from a subterranean geological formation, and related methods. With reference initially to FIGS. 1 and 2, an apparatus 100 adapted to enable regulation of a multi-phase fluid stream flowing from a subterranean geological formation is illustrated.

The apparatus 100 comprises a conduit 101, such as piping or tubing, that defines a flow path for the fluid stream. The apparatus 100 includes an upstream end portion 102 and a downstream end portion 103 adapted to permit attachment (e.g., by threaded attachment) to other equipment. The conduit 101 further defines a first restriction 110 having a throat portion 111. The conduit 101 further defines a first return path 120 including an inlet 121 positioned downstream of the first restriction 110, and an outlet 122 positioned upstream of the inlet of the first return path 120.

The first restriction 110 and the first return path 120 are sized and configured to permit at least a portion of the fluid stream to flow from the inlet 121 to the outlet 122 of the first return path 120. When the fluid stream flows through the first restriction 110, a low pressure zone is generated, relative to the pressure of the fluid stream upstream of the throat portion 111, and downstream of the throat portion 111. The low pressure zone is located at or near the throat portion 111 of the first restriction 110. In one or more embodiments, the outlet 122 of the first return path is positioned at or near the throat portion 111 of the first restriction 110. Thus, when the fluid stream flows through the apparatus 100, the low pressure zone creates a sufficient pressure differential between the fluid stream at the inlet of the return path 121 and the fluid stream at the outlet of the return path 122 so as to cause at least a portion of the fluid stream to flow from the inlet 121 through the outlet 122 of the first return path 120, and into the low pressure zone at or near the throat portion 111 of the first restriction 110.

The first restriction 110 can compress a gas portion of the fluid stream as it flows through the low pressure zone produced at or near the throat of the first restriction 110. The velocity of the fluid stream should be at its highest in the apparatus 100 at the low pressure zone thereby producing a mixing region within the apparatus 100 where the portion of the fluid flowing through the first return path 120 enters the low pressure zone thereby mixing with fluid stream flowing through the first restriction 110. Thus, when the portion of the fluid flowing through the first return path 120 has a lower gas volume fraction than that of the fluid stream entering the first restriction 110, the gas volume fraction of the fluid stream flowing from the apparatus is reduced as compared to a gas volume fraction of the fluid stream upstream of the first restriction 110 (i.e., slug flow is reduced). In this manner, the gas volume fraction of the fluid stream flowing from the apparatus 100 is reduced to an amount that prevents or reduces the likelihood of a pump positioned downstream from the apparatus from gas locking. For example, the gas volume fraction of the fluid stream flowing downstream of the apparatus 100 is preferably less than or equal to about 0.40, and more preferably less than or equal to about 0.30.

In another aspect of the invention, the apparatus 100 can further comprise one or more additional return paths 120, which can be sized, configured, and operated in the same or similar fashion as the first return path described above. For example, in one or more embodiments and as illustrated in FIGS. 1 and 2, the conduit 111 of the apparatus 100 can further define at least a second return path including an inlet positioned downstream of the first restriction, and an outlet positioned upstream of the inlet of the second return path (e.g., at or near the throat portion of the first restriction).

Similarly, in another aspect of the invention, the apparatus can further comprise one or more additional restrictions 110, which can be sized, configured, and operated in the same or similar fashion as the first restriction described above. For example, in one or more embodiments and as illustrated in FIG. 2, the conduit 101 can further define at least a second restriction positioned downstream of the first restriction. The conduit 111 can further comprise at least a second return path including an inlet positioned downstream of the first restriction, and an outlet positioned upstream of the inlet of the second return path. For example, the outlet of the second return path can be positioned at or near, either the throat portion 111 of the first restriction 110 or the throat portion of the second restriction, so as to cause the portion of the fluid stream to flow from the inlet to the outlet of the second return path.

The number of return paths and/or restrictions present in the apparatus 100 generally depend on the desired gas volume fraction for the fluid flowing from the apparatus 100, characteristics of the geological formation and the fluid flowing therefrom, and so forth. Thus, for geological formations having fluid streams with a high gas volume fraction (e.g., intermittent gas volume fraction approaching 1), the apparatus 100 should generally include more restrictions and/or return paths to achieve the desired gas volume fraction for the fluid stream exiting the apparatus, than an apparatus used in geological formations with fluid streams having a lower gas volume fraction.

While dimensions are not necessarily a limitation upon the invention, the first restriction 110 of the apparatus 100 is preferably sized and configured to have a flow area that is about 10% less than the flow area of the portion of the conduit 111 upstream of the first restriction 110. In a case where the apparatus 100 comprises more than one restriction, the flow area for each additional restriction is preferably reduced by about an additional 10%. Thus, for example, in an apparatus 100 having two or more restrictions positioned in series, the first restriction has a flow area that is about 10% of the flow area conduit upstream of the first restriction, and the second restriction has a flow area that is about 20% less than the flow area of the conduit upstream of the first restriction. In such a case, each restriction with a restriction preceding it should be positioned a distance from that preceding restriction of about 5 to 10 times greater than the inside diameter of the throat portion of the preceding restriction. For example, if the apparatus has two restrictions, the second restriction is positioned a distance that is about 5 to 10 times larger than the inside diameter of the throat portion of the first restriction.

Suitable types of restrictions that can be used as the one or more restrictions of the apparatus include without limitation a nozzle, which comprises a converging portion upstream of the throat portion, the throat portion, and a diverging portion downstream of the throat portion, such as a convergent-divergent nozzle, a venturi nozzle, and so forth. In a further embodiment, the one or more restrictions can be configured to telescope into a body assembly with a spring counter balance used to maintain a regulated pressure drop and velocity regulation within each restriction in the body assembly. In still other embodiments, the one or more restrictions can be configured as an orifice plate.

The one or more return paths can be used in several different configurations including without limitation a pathway defined by a wall of the conduit of the apparatus, externally mounted capillary tube or piping conduit, and so forth.

Figure 6:
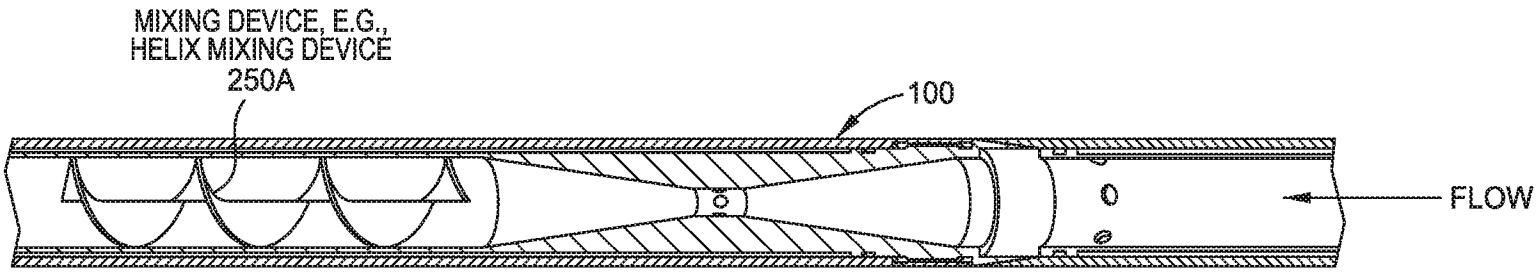
FIG. 6 illustrates an embodiment of an apparatus in accordance with this disclosure.
Figure 7:
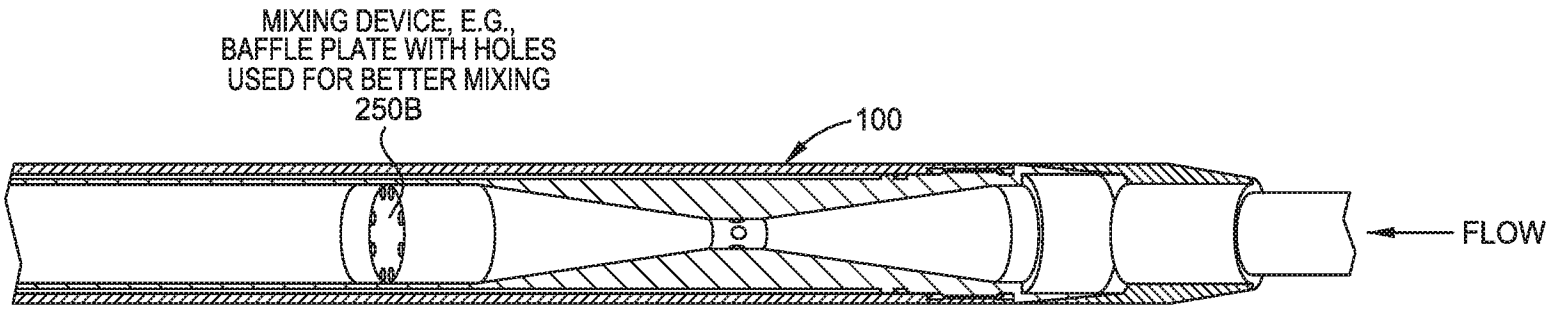
FIG. 7 illustrates an embodiment of an apparatus in accordance with this disclosure.
Figure 8:
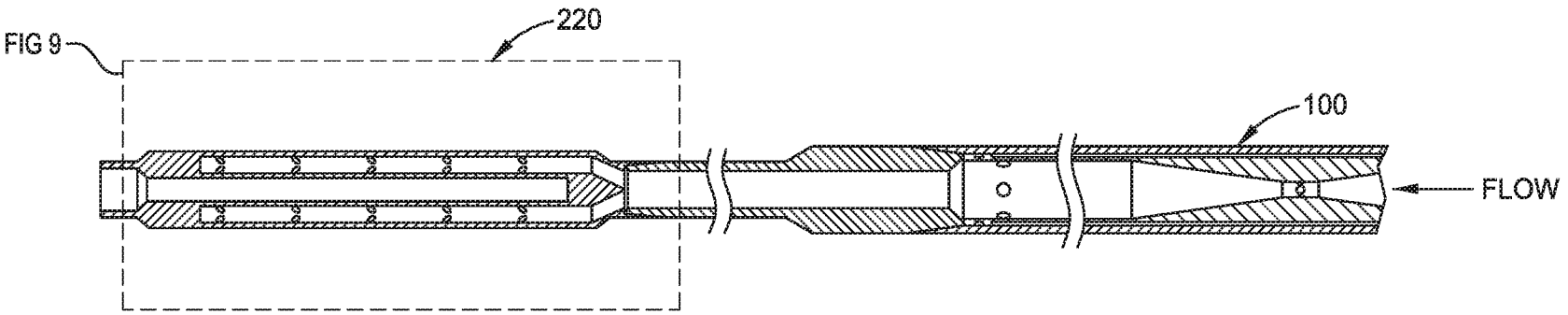
FIG. 8 illustrates a portion of the system illustrated in FIG. 3B.
Figure 9:
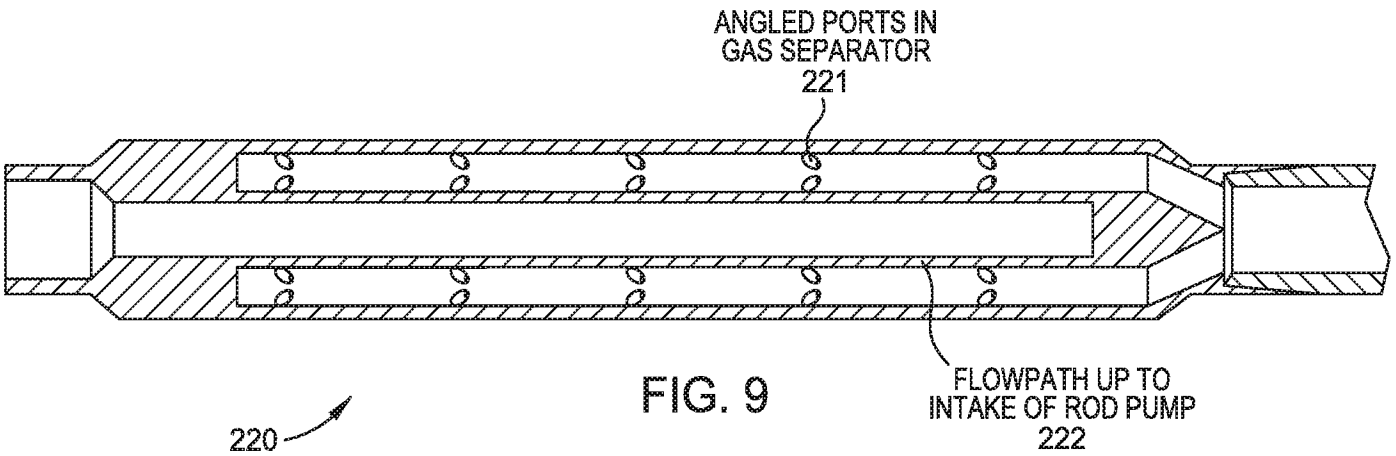
FIG. 9 illustrates a magnified view of a portion of the system illustrated in FIG. 8.

In another aspect of the invention, the apparatus 100 can further comprise a mixing device positioned downstream from each of the one or more restrictions (e.g., downstream of the first restriction and second restriction). In this manner, the fluid stream flowing through the apparatus and one or more restrictions can be subjected to further mixing action. Suitable mixing devices include without limitation a helix mixing device (as shown in FIG. 6), and a baffle plate with holes (as shown in FIG. 7).

While dimensions are not necessarily a limitation upon the invention, the typical dimensions of the apparatus used in down hole applications will have an overall average diameter in the range of about 3.75 to about 5.62 inches, although other dimensions are conceivable and could suffice under some circumstances, as one of skill in the art can appreciate given the benefit of this disclosure. Generally speaking, the overall apparatus length can vary widely, but typically should be about 20 feet.

Another aspect of the invention provides a system 200 for regulating a multi-phase fluid stream flowing from a subterranean geological formation. The system 200 comprises an apparatus 100 as described above, and can further comprise a pump 310 fluidly connected to the apparatus 100, and positioned downstream of the apparatus 100. Suitable types of pumps include without limitation electric submersible pumps (ESPs), rod pumps, and so forth.

The system 200 can further comprise a first phase separator 220 fluidly connected to the apparatus, and positioned downstream of the apparatus 100 and upstream of the pump 210. The first phase separator 220 is sized and configured to separate at least a portion of a gas from the fluid stream. For example, the first phase separator can be a gravity type separating device configured to force fluid out of the separating device to permit lighter fluids (e.g., gas) to travel to the surface. In one or more embodiments, the first phase separator 220 has a diameter that is as large as can be safely accommodated by the well casing to permit adequate spacing and flow passage, which promotes annular gravity separation as the fluid stream flows from inside to the outside of the first phase separator 220 through one or more angled flow ports in the body of the first phase separator 220. The one or more angled flow ports 221 are preferably positioned at about a 45 degree angle, relative to a longitudinal axis of the first phase separator 220. The first phase separator 220 can further comprise one or more fluid intake paths 222 (e.g., tubing or piping conduits) to the pump 210. The first phase separator 220 can further comprise one or more lips which are located on the exterior body of the first phase separator. The one or more lips preferably are positioned at an upward angle relative to the longitudinal axis of the first phase separator body so as to create a more torturous path for the fluid stream flowing through the first phase separator, as well as a more conducive environment for gravity separation of a portion of the gas from the fluid stream. For example, in an embodiment, the one or more lips have an upward angle of about 60 degrees relative to the longitudinal axis of the first phase separator. Suitable types of separators that can be employed as the first separator include without limitation an inverted Y-tool and the like.

The system 200 can further comprise a second phase 230 separator fluidly connected to the apparatus, and positioned upstream of the first restriction, for example upstream of the apparatus. The second phase separator 230 is sized and configured to separate at least a portion of solid materials from the fluid stream. Suitable types of separators that can be employed as the first separator include without limitation a sand separator and the like. It is further contemplated that the system 200 can further comprise additional down hole equipment, piping and tubing as needed (e.g., cup packers 241, 242, centralizers 243, and so forth), depending upon various factors including without limitation the characteristics of the geological formation and the properties of fluid flowing therefrom.

With reference to FIGS. 3A, 3B, 4, 5, 8, and 9, an embodiment of a system 200 in accordance with this disclosure is illustrated. It should be appreciated that the embodiment illustrated in FIGS. 3A, 3B, 4, 5, 8, and 9 is an illustrative example of a system in accordance with this disclosure, and is not intended to limit the scope of the invention. As illustrated, the system 200 comprises an apparatus 100, as described above. The apparatus 100 is fluidly connected to and positioned upstream from a rod pump 210. The system 200 further comprises a first phase separator 220, which is a reverse flow gas separator. The first phase separator 220 is fluidly connected via a threaded connection to the pump 210 and the apparatus 100, and is positioned between the pump 210 and the apparatus 100. The system 200 further comprises a cup packer assembly 240, including two cup packers 241, 242 and a centralizer 243. The cup packer assembly 240 is fluidly connected to the apparatus 100, and positioned upstream from the apparatus 100. Upstream of the cup packer assembly 240, the system 200 further comprises a second phase separator 230 fluidly connected to the cup packer assembly 240 (e.g., by threaded attachment). The second phase separator 230 is also fluidly connected to a predetermined length of production tubing or piping, which is capped on the end. The function of the production tubing or piping is to collect the solids materials separated from the fluid stream by the second phase separator 230 (e.g., sand or other solid materials) by the centrifugal actions of the operation of the second phase separator 230. The collection is generally accomplished via the gravity effect of the solid materials while suspended in the well bore fluid solutions. Normally the produced solids from low drawdown across the horizontal section of a well bore should be minimal, allowing for solid materials collection over a reasonable life of the pump 210.

Another aspect of the invention provides a method of using the apparatuses or systems described above. In operation, an apparatus 100 as described above, or a system 200 comprising an apparatus 100 as described above, is placed within a wellbore conduit defined by a wellbore. A fluid stream from a subterranean geological formation flows into and the apparatus 100 or system 200. As the fluid stream flow through the apparatus 100 or system 200, the gas volume fraction of the fluid stream is reduced to an acceptable level so a pump 210 may accommodate the fluid stream, without experiencing gas lock, and pass the fluid stream towards the ground surface. For example, if the gas volume fraction of the fluid stream is about 0.9 as it enters the apparatus 100 or system 200, then after flowing through the apparatus 100 or system the gas volume fraction of the fluid stream is reduced to less than about 0.4, more preferably less than about 0.3. In this manner, the gas volume fraction of the fluid stream flowing from the apparatus or system is reduced to an amount that prevents or reduces the likelihood of a pump positioned downstream from the apparatus from gas locking.

It should be recognized that unless stated otherwise, it is intended that endpoints are to be interchangeable. Further, any ranges include iterative ranges of like magnitude falling within the expressly stated ranges or limitations disclosed herein is to be understood to set forth every number and range encompassed within the broader range of values. It is to be noted that the terms "range" and "ranging" as used herein generally refer to a value within a specified range and encompasses all values within that entire specified range.

Except as may be expressly otherwise indicated, the article "a" or "an" if and as used herein is not intended to limit, and should not be construed as limiting, a claim to a single element to which the article refers. Rather, the article "a" or "an" if and as used herein is intended to cover one or more such elements, unless the text taken in context clearly indicates otherwise.

Each and every patent or other publication or published document referred to in any portion of this specification is incorporated as a whole into this disclosure by reference, as if fully set forth herein.

This invention is susceptible to considerable variation in its practice. The particular illustrative examples which are described with particularity in this specification are not intended to limit the scope of the invention. Rather, the examples are intended as concrete illustrations of various features and advantages of the invention, and should not be construed as an exhaustive compilation of each and every possible permutation or combination of materials, components, configurations or steps one might contemplate, having the benefit of this disclosure. Similarly, in the interest of clarity, not all features of an actual implementation of an apparatus, system or related methods of use are described in this specification. It of course will be appreciated that in the development of such an actual implementation, numerous implementation-specific decisions must be made to achieve the developers' specific goals, such as compliance with system-related and economic-related constraints, which may vary from one implementation to another. Moreover, it will be appreciated that while such a development effort might be complex and time-consuming, it would nevertheless be a routine undertaking for those of ordinary skill in the art having the benefit of this disclosure. Therefore, the foregoing description is not intended to limit, and should not be construed as limiting, the invention to the particular exemplifications presented hereinabove.

The invention claimed is:

1. An apparatus for regulating a fluid stream flowing from a subterranean geological formation, the apparatus comprising:

a conduit defining at least part of a flow path for the fluid stream flowing from the subterranean geological formation to a ground surface, the conduit comprising:

a first venturi nozzle having a monolithic body comprising a converging portion, a diverging portion, a throat portion between the converging portion and the diverging portion, and an end portion positioned downstream of the diverging portion along the flow path, the end portion having a substantially uniform inner diameter, the throat portion having a first wall and the end portion having a second wall, the monolithic body comprising a varying thickness that increases along the converging portion in a direction toward the throat portion, and the varying thickness decreases along the diverging portion in a direction away from the throat portion, and an outer sleeve disposed outwardly of the monolithic body and coupled to the monolithic body to define a first return path between the monolithic body and the outer sleeve, the first return path including an inlet positioned downstream of the throat portion along the flow path and an outlet positioned upstream of the inlet of the first return path along the flow path, the inlet comprising a plurality of inlet ports extending through the second wall of the end portion, and extending from the flow path and to the first return path such that a portion of the fluid stream flowing from the inlet to the outlet enters the plurality of inlet ports from the flow path and enters the first return path from the plurality of inlet ports, the outlet comprising a plurality of return ports extending through the first wall of the throat portion and from the first return path and to the throat portion such that the portion of the fluid stream flowing from the inlet to the outlet enters the plurality of return ports from the first return path and enters the throat portion from the plurality of return ports; and wherein the first return path is sized and configured to permit the portion of the fluid stream to flow from the inlet to the outlet when the fluid stream flows through the apparatus thereby reducing a gas volume fraction of the fluid stream flowing downstream of the apparatus along the flow path as compared to a gas volume fraction of the fluid stream upstream of the throat portion along the flow path.

2. The apparatus of claim 1, wherein the gas volume fraction of the fluid stream flowing downstream of the apparatus along the flow path is less than or equal to 0.40.

3. The apparatus of claim 1, wherein the conduit further comprises at least a second venturi nozzle positioned downstream of the first venturi nozzle along the flow path.

4. The apparatus of claim 3, wherein the conduit further comprises at least a second return path including an inlet positioned downstream of the first venturi nozzle along the flow path, and an outlet positioned upstream of the inlet of the second return path along the flow path.

5. The apparatus of claim 4, wherein the outlet of the second return path is positioned at or near, either the throat portion of the first venturi nozzle or the throat portion of the second venturi nozzle, so as to cause the portion of the fluid stream to flow from the inlet to the outlet of the second return path.

6. The apparatus of claim 1, wherein the conduit further comprises at least a second return path including an inlet positioned downstream of the first venturi nozzle along the flow path, and an outlet positioned upstream of the inlet of the second return path along the flow path.

7. The apparatus of claim 1, wherein the throat portion of the first venturi nozzle extends between a downstream end of the converging portion and an upstream end of the diverging portion, the converging portion of the first venturi nozzle converges inwardly at a converging angle toward the throat portion, the diverging portion diverges outwardly at a diverging angle from the throat portion, and each of the converging angle and the diverging angle is an acute angle.

8. A method for regulating a fluid stream flowing from a subterranean geological formation, the method comprising:

placing an apparatus within a wellbore conduit defined by a wellbore, wherein the apparatus comprises a conduit defining at least part of a flow path for the fluid stream flowing from the subterranean geological formation to a ground surface, the conduit comprising a first venturi nozzle having a monolithic body comprising a converging portion, a diverging portion, a throat portion between the converging portion and the diverging portion, and an end portion positioned downstream of the diverging portion along the flow path, the end portion having a substantially uniform inner diameter, the throat portion having a first wall and the end portion having a second wall, the monolithic body comprising a varying thickness that increases along the converging portion in a direction toward the throat portion, and the varying thickness decreases along the diverging portion in a direction away from the throat portion, and an outer sleeve disposed outwardly of the monolithic body and coupled to the monolithic body to define a first return path between the monolithic body and the outer sleeve, the first return path including an inlet positioned downstream of the first venturi nozzle along the flow path and an outlet positioned upstream of the inlet of the first return path along the flow path, the inlet comprising a plurality of inlet ports extending through the second wall of the end portion, and extending from the flow path and to the first return path such that a portion of the fluid stream flowing from the inlet to the outlet enters the plurality of inlet ports from the flow path and enters the first return path from the plurality of inlet ports, the outlet comprising a plurality of return ports extending through the first wall of the throat portion and from the first return path and to the throat portion such that the portion of the fluid stream flowing from the inlet to the outlet enters the plurality of return ports from the first return path and enters the throat portion from the plurality of return ports; and wherein the first return path is sized and configured to permit the portion of the fluid stream to flow from the inlet to the outlet when the fluid stream flows through the apparatus thereby reducing a gas volume fraction of the fluid stream flowing downstream of the apparatus along the flow path as compared to a gas volume fraction of the fluid stream upstream of the throat portion along the flow path.

9. The method of claim 8, wherein the gas volume fraction of the fluid stream flowing downstream of the apparatus along the flow path is less than or equal to 0.40.

10. The method of claim 8, wherein the conduit further comprises at least a second venturi nozzle positioned downstream of the first venturi nozzle along the flow path.

11. The method of claim 10, wherein the conduit further comprises a second return path having an inlet positioned downstream of the throat portion of the first venturi nozzle along the flow path, and an outlet positioned upstream of the inlet of the second return path along the flow path.

12. The method of claim 11, wherein the second venturi nozzle has a throat portion, a converging portion upstream of the throat portion of the second venturi nozzle along the flow path and a diverging portion downstream of the throat portion of the second venturi nozzle along the flow path.

13. A system for regulating a fluid stream flowing from a subterranean geological formation, the system comprising:

an apparatus comprising a conduit defining at least part of a flow path for the fluid stream flowing from the subterranean geological formation to a ground surface, the conduit comprising a first venturi nozzle having a monolithic body comprising a converging portion, a diverging portion, a throat portion between the converging portion and the diverging portion, and an end portion positioned downstream of the diverging portion along the flow path, the end portion having a substantially uniform inner diameter, the throat portion having a first wall and the end portion having a second wall, the monolithic body comprising a varying thickness that increases along the converging portion in a direction toward the throat portion, and the varying thickness decreases along the diverging portion in a direction away from the throat portion, and an outer sleeve disposed outwardly of the monolithic body and coupled to the monolithic body to define a first return path between the monolithic body and the outer sleeve, the first return path including an inlet positioned downstream of the throat portion along the flow path and an outlet positioned upstream of the inlet along the flow path, the inlet comprising a plurality of inlet ports extending through the second wall of the end portion, and extending from the flow path and to the first return path such that a portion of the fluid stream flowing from the inlet to the outlet enters the plurality of inlet ports from the flow path and enters the first return path from the plurality of inlet ports, the outlet comprising a plurality of return ports extending through the first wall of the throat portion and from the first return path and to the throat portion such that the portion of the fluid stream flowing from the inlet to the outlet enters the plurality of return ports from the first return path and enters the throat portion from the plurality of return ports, wherein the first return path is sized and configured to permit the portion of the fluid stream to flow from the inlet to the outlet when the fluid stream flows through the apparatus thereby reducing a gas volume fraction of the fluid stream flowing downstream of the apparatus along the flow path as compared to a gas volume fraction of the fluid stream upstream of the throat portion along the flow path.

14. The system of claim 13, further comprising a pump positioned downstream of the apparatus along the flow path.

15. The system of claim 14, further comprising a first phase separator positioned downstream of the throat portion along the flow path and upstream of the pump along the flow path, wherein the first phase separator is sized and configured to separate at least a portion of a gas from the fluid stream.

16. The system of claim 15, wherein the first phase separator is a gravity type separation device.

17. The system of claim 15, further comprising a second phase separator positioned upstream of the throat portion along the flow path, wherein the second phase separator is sized and configured to separate at least a portion of solid materials from the fluid stream.

* * * * *